US008906120B2

(12) United States Patent
Metcalfe et al.

(10) Patent No.: US 8,906,120 B2
(45) Date of Patent: Dec. 9, 2014

(54) FUEL ENRICHMENT PROCESS

(76) Inventors: Colin Metcalfe, Wynyard (GB); David Dixon, Cramlington (GB)

( * ) Notice: Subject to any disclaimer, the term of this patent is extended or adjusted under 35 U.S.C. 154(b) by 278 days.

(21) Appl. No.: 12/866,754

(22) PCT Filed: Feb. 9, 2009

(86) PCT No.: PCT/GB2009/050127

§ 371 (c)(1), (2), (4) Date: Sep. 24, 2010

(87) PCT Pub. No.: WO2009/098523

PCT Pub. Date: Aug. 13, 2009

(65) Prior Publication Data

US 2011/0016777 A1 Jan. 27, 2011

(30) Foreign Application Priority Data

Feb. 7, 2008 (GB) ..... 0802260.0

(51) Int. Cl.
*C10L 5/00* (2006.01)
*C10L 9/12* (2006.01)

(52) U.S. Cl.
CPC ..... *C10L 9/12* (2013.01)
USPC ..... 44/620; 44/603; 44/627

(58) Field of Classification Search
USPC ..... 44/620, 627, 603
See application file for complete search history.

(56) References Cited

U.S. PATENT DOCUMENTS 3,332,755 A * 7/1967 Kukin ..... 44/603
4,210,423 A * 7/1980 Yan ..... 44/501
6,250,235 B1 * 6/2001 Oehr et al. ..... 110/342

* cited by examiner

*Primary Examiner* — Cephia D Toomer

(57) ABSTRACT

A process for reducing the carbon content of ash from a burner comprises heating a carbon-based fuel in the presence of a fuel improver in a burner. The fuel improver comprises at least one metal oxide selected from the group comprising: iron oxide, calcium oxide, silicon dioxide, magnesium oxide and aluminum oxide. The average particle size of the fuel improver is reduced to give a particle size in the range 1 to 100 micron.

11 Claims, 4 Drawing Sheets

FUEL ENRICHMENT PROCESS

FIELD OF THE INVENTION

The invention relates to a process for improving the combustion of fossil fuels, and more specifically to an improved process for the combustion of coal which results in an ash by-product with a low carbon content, and to a fuel improver composition for use in the process.

BACKGROUND OF THE INVENTION

Ash is a by-product generated in the combustion of coal. Fly ash is generally captured from the chimneys of power stations and bottom ash is removed from the bottom of the furnace. In the UK, just over 1,000,000 tonnes of fly ash is produced annually.

Worldwide a large proportion of ash produced from coal fired power stations is disposed of in landfill or stored in slag heaps. Some countries impose a tax on the disposal of such waste in landfill. The recycling of ash has become an increasing concern in recent years due to increasing landfill costs as well as environmental costs.

A significant portion of this ash is pozzolanic in nature, which means that when combined with calcium hydroxide it exhibits cementitious properties. In principle fly ash can be used as a replacement for a proportion of Portland cement content of concrete mixtures. Production of Portland cement itself is energy-intensive and produces a large amount of carbon dioxide, approximately one tonne of carbon dioxide per tonne of Portland cement, so replacement of a proportion of this with an otherwise unused by-product could dramatically reduce carbon emissions.

However, ash comprising a high percentage of unburned carbon is not useable as a Portland cement substitute since the ash then has a tendency to adsorb important cementitious chemical admixtures from the concrete during the mixing process. This renders admixtures unavailable to effect their intended purpose. Ash with a carbon content of 7% or less is desirable for use as a pozzolan.

Fly ash can be processed to reduce the carbon content to levels sufficient for use as a pozzolan. Examples of such processes include re-burning the fly ash to reduce the carbon content; electrostatic separation processes which produce low carbon fractions and the chemical treatment of fly ash to minimize the effect of the carbon content by reducing the adsorptive properties of the carbon. All of these processes require at least one additional processing step, adding to the overall cost of producing a useful by-product rather than a waste product.

In Europe there is a legal requirement for power stations to reduce emissions of nitrous and sulphurous oxides, known as $NO_x$ and $SO_x$ emissions. This has led to coal fired power stations being fitted with low $NO_x$ burners. Whilst reducing $NO_x$ and $SO_x$ emissions, these burners also lead to a slight loss in combustion efficiency which can in turn lead to high levels of carbon in the ash, typically in the region of 20% carbon, rendering the ash an undesirable waste product.

Chinese patent numbers CN1077482, CN1396239, and CN1396239 describe fuel combustion additives. Such additives consist of a range of metals and metal oxides blended in a specific weight proportions. All of these additives are added to the fuel above its standard amount so the amount of fuel used is not reduced.

There also exist millions of tonnes of slag resulting from the extraction of metals from ore.

It would be desirable to provide an improved process for the combustion of coal, providing ash with a low carbon content that renders the ash a desirable and marketable by-product, rather than a waste product that would need to be disposed of in a manner to satisfy environmental regulations. In addition, it would be desirable to provide an improved process in which the amount of coal burned is reduced whilst not reducing the energy output and preferably increasing the energy output and reducing carbon emissions. It would also be desirable to provide a use for slag by-products.

SUMMARY OF THE INVENTION

One aspect of the invention provides a process for reducing the carbon content of ash from a burner comprising heating a carbon-based fuel in the presence of a fuel improver in a burner, the fuel improver comprising at least one metal oxide selected from the group comprising: iron oxide, calcium oxide, silicon dioxide, magnesium oxide and aluminium oxide, wherein the average particle size of the fuel improver is in the range 1 to 100 micron.

Another aspect of the invention provides a fuel improver composition comprising at least one metal oxide selected from the group comprising: iron oxide, calcium oxide, silicon dioxide, magnesium oxide and aluminium oxide, wherein the fuel improver is in the range 1 to 100 micron.

Another aspect of the invention provides a method of producing a pozzolan comprising heating a carbon-based fuel in the presence of a fuel improver in a burner, the fuel improver comprising at least one metal oxide selected from the group comprising: iron oxide, calcium oxide, silicon dioxide, magnesium oxide and aluminium oxide, wherein the average particle size of the fuel improver is in the range 1 to 100 micron; and recovering the ash from the burner.

Another aspect of the invention provides a method of producing a cementitious composition comprising heating a carbon-based fuel in the presence of a fuel improver in a burner, the fuel improver comprising at least one metal oxide selected from the group comprising: iron oxide, calcium oxide, silicon dioxide, magnesium oxide and aluminium oxide, wherein the average particle size of the fuel improver is in the range 1 to 100 micron; recovering the ash from the burner and mixing the ash with calcium hydroxide.

Preferably the average particle size of the fuel improver is in the range 1 to 80 micron. More preferably the average particle size is in the range to 33 micron. Still more preferably the average particle size is in the range 5 to 25 micron. Still more preferably the average particle size is in the range 8 to 20 micron.

Typically, the fuel improver material is reduced to give an average particle size in the ranges referred to above.

Preferably the average particle size of the fuel improver is reduced by pulverisation.

Preferably the fuel improver replaces a proportion of the carbon-based fuel in an amount in the range 2.5% to 33% by weight. More preferably the fuel improver replaces a proportion of the carbon-based fuel in an amount in the range 5% to 33% by weight. Still more preferably the fuel improver replaces a proportion of the carbon-based fuel in an amount in the range 5 to 15% by weight.

The carbon-based fuel may be a fossil fuel. Preferably the fossil fuel is coal. More preferably the coal is pulverised prior to introduction to the burner.

Another aspect of the invention provides a method of increasing the fuel efficiency of a combustion process comprising the step of replacing a proportion of the carbon-based fuel to be burned with a fuel improver, the fuel improver comprising at least one metal oxide selected from the group comprising: iron oxide, calcium oxide, silicon dioxide, magnesium oxide and aluminium oxide.

Preferably the average particle size of the fuel improver is in the range 1 to 100 micron. More preferably the average particle size of the fuel improver is in the range 1 to 80 micron. Still more preferably the average particle size is in the range 3 to 33 micron. Still more preferably the average particle size is in the range 5 to 25 micron. Still more preferably the average particle size is in the range 8 to 20 micron.

The method may include the step of reducing the particle size of the fuel improver material to give a particle size in the ranges referred to above.

Preferably the average particle size of the fuel improver is reduced by pulverisation.

Favourably the fuel improver composition comprises chemical elements belonging to periods 3 and 4 (groups II-V) of the Periodic Table.

Favourably the fuel improver composition comprises oxides or other compounds of chemical elements belonging to periods 3 and 4 (groups II-V) of the Periodic Table.

The invention provides a fuel improver that is either mixed with the carbon-based fuel prior to introduction into the combustion chamber, or injected into the combustion chamber alongside the fuel. The fuel improver releases free oxygen radicals when heated. The presence of this fuel improver improves the oxidation of the carbon fraction of the coal leading to improved efficiency and a reduction in the resulting carbon content of the ash, producing a useful material instead of a waste product. Use of the fuel additive also leads to a reduction in the emissions of $NO_x$ and $SO_x$ gases since the air requirements of the burner are reduced for the same carbon input, and extra oxygen to complete the combustion of the fuel is sourced from the fuel improver rather than from additional air. Since the oxidation of the carbon fraction of the fuel is improved this also leads to reduced consumption of solid fuel for the same energy output.

BRIEF DESCRIPTION OF THE DRAWINGS

In the drawings, which illustrate preferred embodiments of the invention.

DETAILED DESCRIPTION OF THE PREFERRED EMBODIMENTS

The improved combustion process of the invention involves the injection of a fuel improver into the main burner in a carbon-based fuel burner, for example a coal fired power station. The fuel improver is derived from a mixture of metal oxides typically sourced from slags, which are by-products of metal smelting processes, typically in the production of copper and nickel. Slag materials comprise excess oxygen in the form of metal oxides and the inventors have found that it is possible to release this oxygen into the burner by heating to a sufficient temperature. The fuel improver may include oxides such as Iron oxide, Calcium oxide, Silicon dioxide, Magnesium oxide and Aluminium oxide, among others as shown on Table 1. See Table 1 for the X-Ray Fluorescence (XRF) analysis of two fuel improver samples. A variety of different oxides may be used from varying sources and in varying amounts. The composition of slag will vary depending on the type of ore being smelted and the origin of the ore itself. As shown in the table, oxides of iron and silicon predominate.

TABLE 1

XRF analysis of two samples of fuel additive.

| Component | Sample 1 | Sample 2 |
|---|---|---|
| Fe (total) % | 50.2 | 50.1 |
| CaO % | 3.18 | 3.19 |
| SiO2 % | 37.59 | 38.98 |
| MgO % | 3.20 | 3.22 |
| A12O3 % | 5.57 | 5.72 |
| P % | 0.035 | 0.036 |
| Mn % | 0.054 | 0.053 |
| S % | 1.610 | 1.400 |
| K20 % | 0.680 | 0.690 |
| V205 % | 0.018 | 0.018 |
| Ti02 % | 0.320 | 0.320 |
| Zno % | 0.080 | 0.080 |
| PbO % | 0.001 | 0.001 |
| Na2O % | 0.600 | 0.600 |

Note—
the Fe content include oxides of Fe, predominantly $Fe_2O_3$

Figure 1:
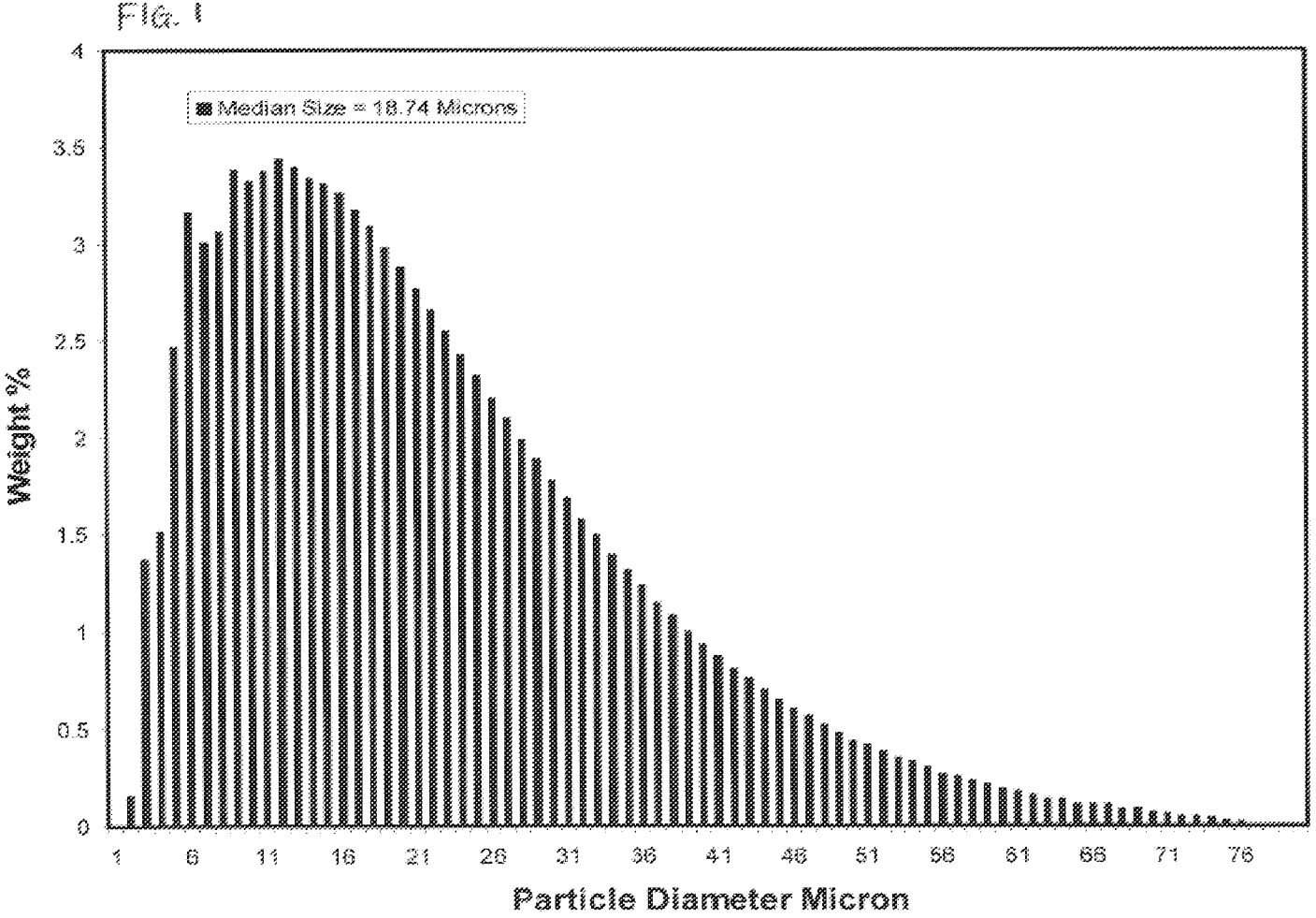
FIG. 1 is a graph showing the distribution of particle sizes of the fuel improver after pulverisation using a roller mill.
Figure 2:
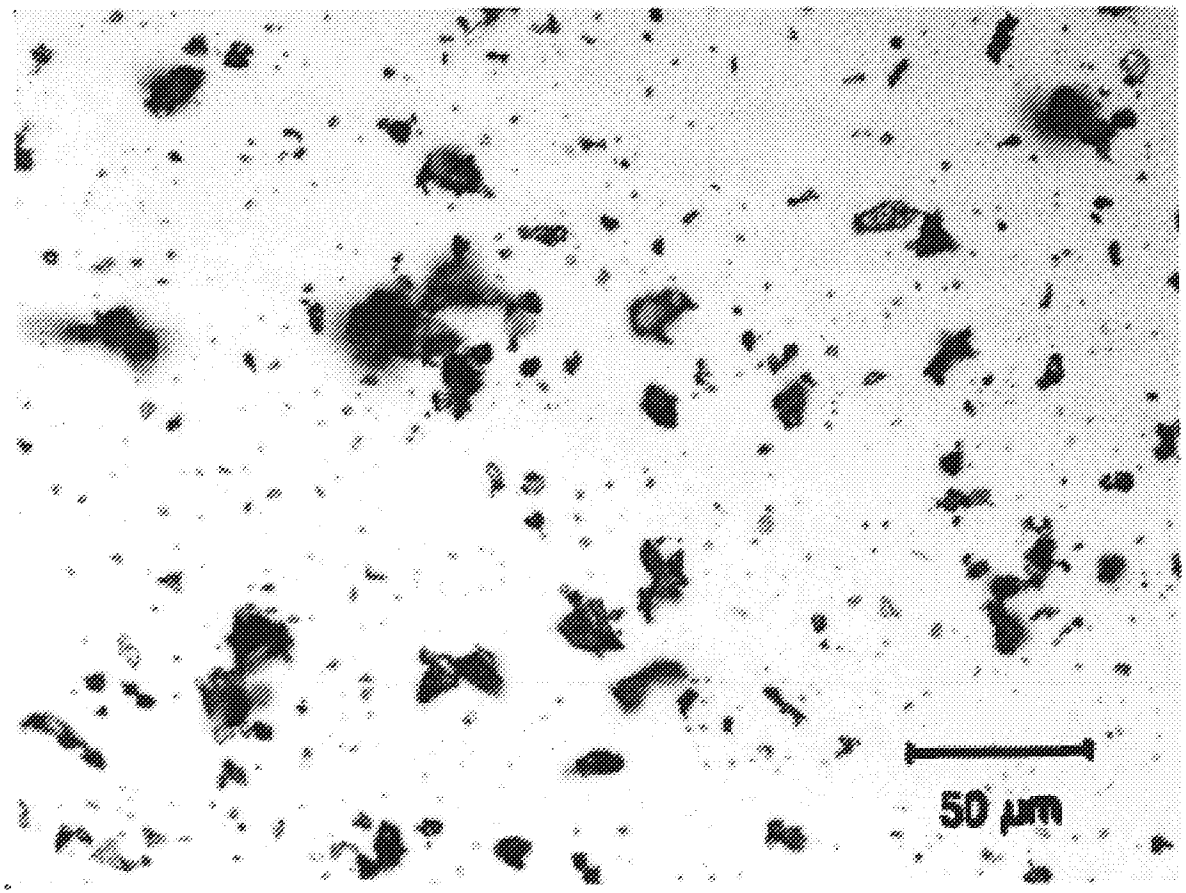
FIG. 2 is a photograph of the pulverised fuel improver showing the particle sizes.

The fuel improver composition of the invention typically contains chemical elements and their oxides belonging to periods 3 and 4 (groups II-V) of the Periodic Table. Preferably the particle size of the inventive fuel improver is reduced. This may destroy or deform or strain the crystal lattice of the improver compounds which may make the oxygen in the improver compounds more available to react with the coal. Reducing the particle size of the improver also increases the surface area of the improver, increasing rates of reaction. Preferably the particle size of the fuel improver is reduced by pulverisation (fine grinding). The fuel improver is preferably pulverised using a mill suitable for producing fine powders from hard materials such as a ball mill or a roller mill as described in UK patent application number GB0719426.9. FIG. 1 is a graph showing the range in diameter of particle sizes after passing through the mill. The median particle size in this example is 18.74 microns.

Experiments have been conducted to investigate the release of oxygen from the fuel improver. Four different improver compositions (A, B, C and D) were combined with coal in varying amounts. Improver compositions A and B were sourced from air quenched slag. Improver composition C was sourced from a water quenched slag. The combustion of the different mixtures was analysed and compared to a blank run with only coal present. Composition A corresponds to Sample 1 in Table 1; Composition B corresponds to Sample 2 in Table 1; and Composition C corresponds in analysis to Sample 1, but because this sample is water quenched it has a different structure to air quenched Composition A. The analysis of Sample D (American Ore) is given in Table 2 below:

| XRF Analysis | Results % |
|---|---|
| Fe (total) | 63.84 |
| Fe2O3 | NR |

-continued

| XRF Analysis | Results % |
|---|---|
| CaO | 1.11 |
| SiO2 | 4.53 |
| MgO | 0.59 |
| Al2O3 | 0.68 |
| P | 0.012 |
| P2O5 | NR |
| Mn | 0.039 |
| MnO | NR |
| S (by Leco Combustion) | 0.540 |
| K2O | 0.540 |
| V2O5 | 0.002 |
| TiO2 | 0.047 |
| BaO | NR |
| ZnO | 0.230 |
| PbO | 0.020 |
| Na2O | 0.090 |
| Cr2O3 | NR |

Figure 3:
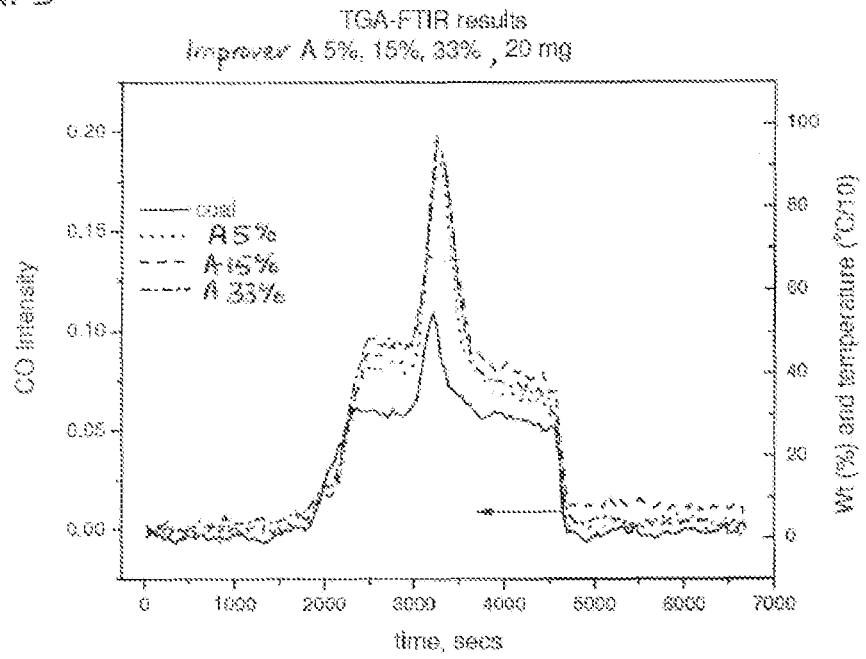
FIG. 3 is a graph showing CO release during the combustion of different mixtures of fuel improver and coal.
Figure 4:
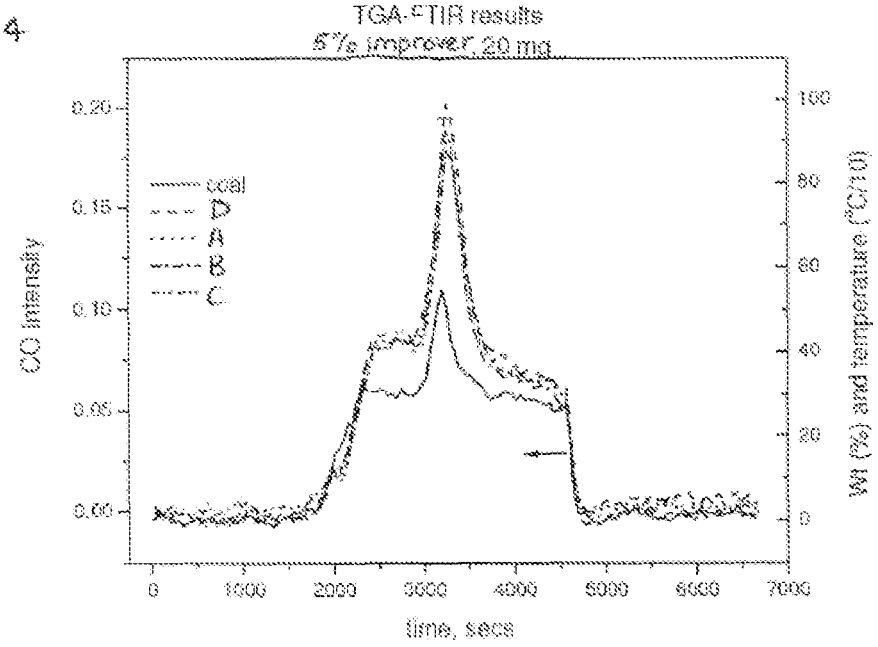
FIG. 4 is a graph showing CO release during the combustion of mixtures of 5% fuel improver and 95% coal.
Figure 5:
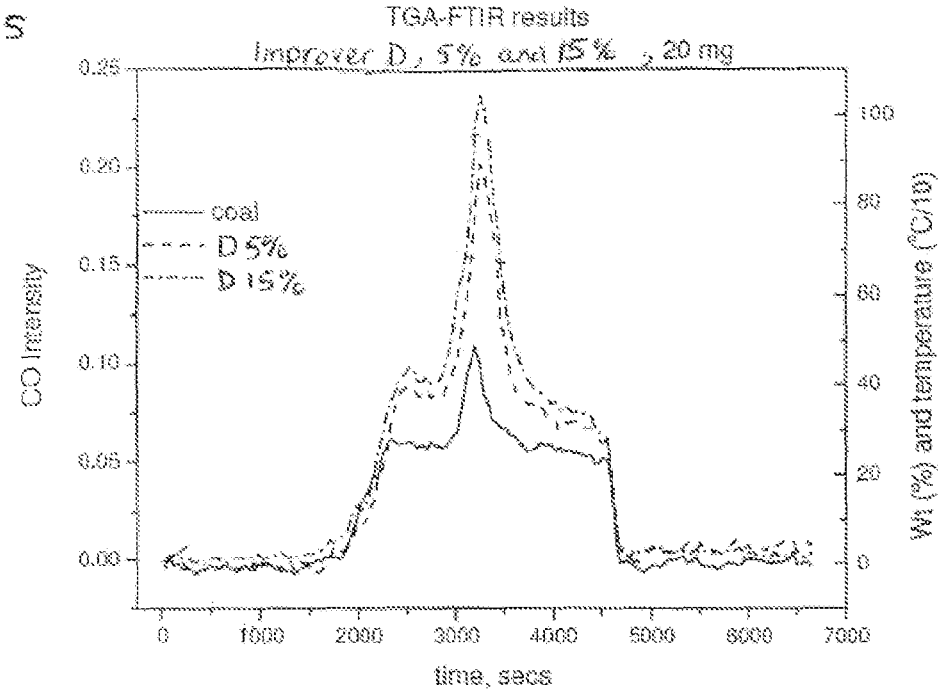
FIG. 5 is a graph showing CO release during the combustion of different mixtures of fuel improver and coal.

The release of carbon monoxide and carbon dioxide was monitored for each mixture using a Fourier transform infrared spectrometer. The results are shown in FIGS. 3, 4 and 5, these results show that an increase in the production of CO was seen when the fuel improver was present, indicating that oxygen is being released from the fuel improver.

Figure 6:
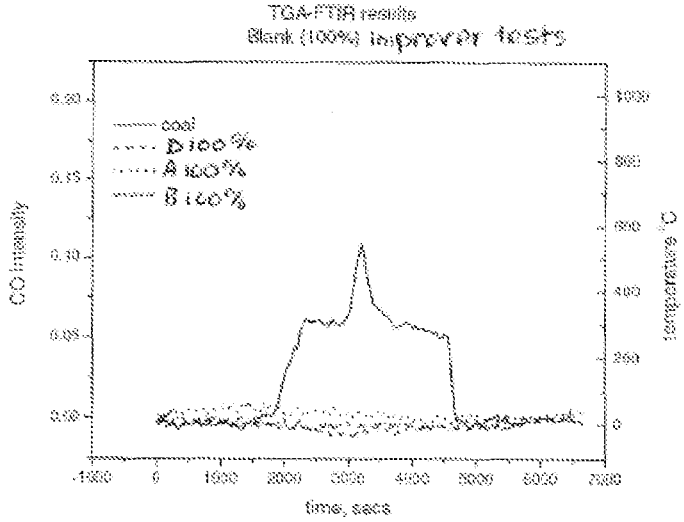
FIG. 6 is a graph showing CO release during the combustion of fuel improvers alone compared with CO release during the combustion of coal alone.

Blank runs with only fuel improver present showed no production of CO (see FIG. 6).

In power plants which burn pulverized coal, the milled fuel improver additive may be pre-mixed with pulverised coal prior to injection into the burner. Alternatively the milled fuel improver additive may be added to the burner separately from the coal.

In a particular example a fuel improver was prepared which included chemical elements in periods 3 and 4 (groups II-V) of the Periodic Table, along with their oxides and compounds. In particular these elements included Silicon, Iron and Magnesium in the form $Mg_6(Si_4O_{10})(OH)_8$ and $Fe_2O_3$. The improver composition was pulverized to obtain small particles, 85-90% of which were sized in the range 10-40 micron; and 10-15% in the range 70-80 micron. These small pulverized particles were mixed by injection with underfire air heated to between 200 and 250° C. Subsequently the finely dispersed fuel improver was jet injected and mixed with pulverized coal until a homogeneous mixture was obtained, with the fuel improver replacing 6% of the coal. The coal/improver mixture was then delivered for combustion to the boiler furnace to be burnt in a torch. The improver was introduced to the torch base together with coal through regular boiler burners using pulverized coal and was evenly dispersed throughout the space of the hydrocarbon fuel combustion zone. Bright bursts were observed when the improver reached the torch bases with a temperature in the range 300 to 600° C. The atmospheric air consumption of the boiler was reduced by 14% as a result of the introduction of the fuel improver. Consumption of hydrocarbon fuel was reduced by 6%. Analysis of flue gases by a gas analyser revealed a 14% reduction in $O_2$ (atomic oxygen), a 5% reduction of $CO_2$ (carbon dioxide), a 20% reduction of CO (carbon monoxide), a 20% reduction of $NO_x$ (nitrogen oxides), and a 3% reduction of $SO_2$ (sulphur dioxide). Methane was not present in the flue gases. The temperature of flue gases was reduced by 15%.

In a further example coal was co-burnt with a fuel improver in a boiler with a grate-fired furnace. The improver comprised a blend of chemical elements and their compounds from periods 3 and 4 (groups II-V) of the Periodic Table, in particular, iron oxide (FeO and/or $Fe_2O_3$), quartz oxide ($SiO_2$), aluminium oxide ($Al_2O_3$), calcium oxide (CaO), magnesium oxide (MgO), and manganese oxide (MnO), among others. The fuel improver was pulverized to give small particles with sizes in the range 70 to 100 micron. The pulverized improver was fed into the furnace separately from the fuel, and was evenly distributed on top of the coal layer, replacing 9.5% of volumetric fuel consumption per boiler. Hot air (60° C.) was injected from below through the furnace grate, coming upwards through the coal and improver. Analysis of flue gases by a gas analyser revealed a 20% reduction in $O_2$ (atomic oxygen), a 7% reduction of $CO_2$ (carbon dioxide), a 22% reduction of CO (carbon monoxide), a 20% reduction of $NO_x$ (nitrogen oxides), and a 4% reduction of $SO_2$ (sulphur dioxide). Methane was not present in the flue gases. The temperature of flue gases was reduced by 20%.

The fuel improver replaces a proportion of the carbon-based fuel in the burner. For example the fuel improver may replace 5% of the fuel by weight, giving a mixture of 95% coal and 5% improver. The amount of fuel used in the combustion process is therefore reduced, however the process yields more energy. As less carbon-based fuel is used, there is less carbon present in the ash, and there are fewer carbon emissions. The amount of $NO_x$ and $SO_x$ emissions are also reduced since extra oxygen to complete combustion of the fuel is sourced from the fuel improver rather than from additional air.

The invention claimed is:

1. A process for reducing the carbon content of ash from a burner comprising heating a carbon-based fuel in the presence of a fuel improver in a burner, the fuel improver comprising predominantly iron oxide and silicon dioxide, wherein the average particle size of the fuel improver is in the range 1 to 100 micron, and wherein the fuel improver comprises calcium oxide, and wherein the fuel improver replaces a proportion of the fuel in an amount in the range 2.5% to 33% by weight.

2. A process as claimed in claim 1, wherein the particle size of the fuel improver is in the range 1 to 80 micron.

3. A process as claimed in claim 1, wherein the particle size of the fuel improver is reduced through pulverisation.

4. A process as claimed in claim 1, wherein the carbon-based fuel is a fossil fuel.

5. A process as claimed in claim 4, wherein the fossil fuel is coal.

6. A process as claimed in claim 5, wherein the coal is pulverised prior to introduction into the burner.

7. A method of increasing the fuel efficiency of a combustion process comprising the step of replacing a proportion of the carbon-based fuel to be burned with a fuel improver, the fuel improver comprising predominantly iron oxide and silicon dioxide, wherein the average particle size of the fuel improver is in the range 1 to 100 micron and wherein the fuel improver replaces a proportion of the fuel in an amount in the range 2.5% to 33% by weight and wherein the fuel improver comprises calcium oxide.

8. A method as claimed in claim 7, wherein the average particle size of the fuel improver is in the range 1 to 80 micron.

9. A method as claimed in claim 8, wherein the particle size of the fuel improver is reduced through pulverisation.

10. A method as claimed in claim 7, wherein the carbon-based fuel is a fossil fuel.

11. A process as claimed in claim 1, the fuel improver further comprising at least one metal oxide selected from the group consisting of magnesium dioxide and aluminium oxide.

* * * * *